US010799751B2

(12) United States Patent
Kelly

(10) Patent No.: US 10,799,751 B2
(45) Date of Patent: Oct. 13, 2020

(54) OLYMPIC PLATE WEIGHTED VEST

(71) Applicant: Sean Kelly, Miami Beach, FL (US)

(72) Inventor: Sean Kelly, Miami Beach, FL (US)

( * ) Notice: Subject to any disclaimer, the term of this patent is extended or adjusted under 35 U.S.C. 154(b) by 35 days.

(21) Appl. No.: 16/139,626

(22) Filed: Sep. 24, 2018

(65) Prior Publication Data

US 2020/0094098 A1 Mar. 26, 2020

(51) Int. Cl.
*A63B 21/065* (2006.01)
*A63B 21/00* (2006.01)

(52) U.S. Cl.
CPC ..... *A63B 21/065* (2013.01); *A63B 21/4007* (2015.10)

(58) Field of Classification Search
CPC ..... A63B 21/065; A63B 21/4007; A63B 21/00061; A63B 21/00065; A63B 21/06; A63B 21/072; A63B 21/0728; A41D 1/04; A41D 13/0007; A41D 13/0012; A41D 13/055; A41D 13/0556; A41D 13/0562; A41D 13/0568; F41H 1/02
See application file for complete search history.

(56) References Cited

U.S. PATENT DOCUMENTS 2,640,987 A * 6/1953 Ehlers ..... F41H 1/02 2/2.5
4,658,442 A * 4/1987 Tomlinson ..... A63B 21/065 2/102
4,948,122 A * 8/1990 Andrews, Sr. ..... A63B 21/065 482/105
5,002,270 A * 3/1991 Shine ..... A63B 21/065 2/102
6,029,270 A * 2/2000 Ost ..... A41D 3/00 2/2.5
7,490,361 B1 * 2/2009 Floyd ..... A41D 13/0512 2/94
10,455,873 B2 * 10/2019 Feterman ..... A45C 13/10
2017/0354530 A1 * 12/2017 Shagdar ..... A41D 13/0525
2018/0161615 A1 * 6/2018 Feng ..... A63B 21/065

* cited by examiner

*Primary Examiner* — Loan B Jimenez
*Assistant Examiner* — Catrina A Letterman
(74) *Attorney, Agent, or Firm* — Nasser Ashgriz; UIPatent Inc.

(57) ABSTRACT

The present invention is a weighted vest, for receiving standard Olympic weight plates. The vest has a plurality of vest pockets at least in two rows and in the front and in the rear. The top row pockets are each sized to receive up to three 2.5-pound standard Olympic weight plates and the bottom row pockets are sized to each receive up to three 5-pound standard Olympic weight plates. Each pocket has a weight holder with a length adapted to receive 1 to 3 standard Olympic weight and locked by a locking means and a pocket flap to securely hold the weight plates in the pocket.

8 Claims, 14 Drawing Sheets

OLYMPIC PLATE WEIGHTED VEST

FIELD OF THE INVENTION

The present invention relates in general to weighted apparel that are used for exercise, and in particular to weighted vests worn by athletes and the public trying to improve their respective levels of physical fitness by adding weight resistance during training and related physical activities.

BACKGROUND OF THE INVENTION

Weighted vests are used to add extra weight to one's body weight during exercise or training. Weighted vests are generally similar in structure and form to a normal vest and are adjustable to a user's size. The prior art weighted vests comprise of a set of pockets that are shaped and sized to hold a specific set of weights. These weights are typically of specific size and shape and are especially designed to fit in the pockets of the vest. It is not possible to use any other type of weight other than their especially designed weights. The main problem with these vests is that one has to carry the especially designed weights together with the vest. Also, if the especially designed weights are misplaced or lost, the weighted vest becomes useless. In addition, most weighted vests have a certain number of pockets that can receive a certain amount of weights. Therefore, a user cannot add more weight other than the amount of the weight that is provided by the manufacturer of the vest. The specific weights are not standard and cannot have any other use other than for adding weight to the particular weighted vest to which they are associated.

SUMMARY OF THE INVENTION

The present invention is a weighted vest designed to receive standard Olympic weight plates. The Olympic weight plates are found in almost any typical gym or at any supplier of gym and physical fitness equipment. Therefore, they are commonly and easily available. Olympic weight plates come in 2.5 and 5 pound increments (and their equivalents in kilograms) as well as many smaller "micro-plate" weights (less than 2.5 pounds). Therefore, the user can easily change the weight size with a wide range of standard weight choices and all with standard shapes. Therefore, the present vest overcomes the shortcomings of the prior art weighted vests, in terms of the availability and the amount of weights that can be used in the vest.

The weighted vest of the present invention comprises a pair of symmetrical front and rear panels joined by two shoulder portions. The present weighted vest has a plurality of pockets formed on both the front and rear panels of the vest. The pockets are shaped and sized to receive one or more standard Olympic weight plates. In one embodiment, four pockets are designed on each panel for a total of eight pockets. Each pocket has a flap with a hook and loop attachment to secure the weight plates in the pocket. The hook and loop attachments are extended over an entire or a substantial length of the flap and the pocket, so that the flap can be attached to the lower part of the pocket or the upper part of the pocket.

In another embodiment of the weighed vest, each pocket has a weight holder with a length adapted to receive several, preferably 1 to 3, standard Olympic weights. The weight holder is a bar perpendicularly attached to the center of each pocket. Each weight holder has a locking mechanism at its free end to securely hold the weight plates on the weight holder. The weight holder is approximately 2 inches in diameter which is the universal standard for all Olympic plates of any weight.

The bar is securely fastened from its distal end to the vest in a manner to hold the weight plates in place without bending. A pad made from a rigid material is placed in a pocket area. The bar is then rigidly fastened to the pad. The bar can fasten by threading and washer mechanism or any other rigid attachment mechanism.

In another embodiment of the weighted vest, each vest pocket comprises a pocket flap permanently attached to the vest at the bottom of the pocket area and removably attached to the vest at the top of the pocket area. The pocket flap has a hole thereon for the weight bar holder to stick therefrom and being secured with the locking means to hold and prevent any movement of the weight plates. In operation, the pocket flap is opened, the weight plates are set on the weight bar and then the pocket flap is closed over the weight plates. Then, the locking mechanism is attached to the bar, locking the weight plates in place.

The two top pockets on each side of the vest can hold preferably 1 to 3 standard 2.5 pound Olympic weight plates. The two bottom pockets on each side of the vest can hold preferably 1-3 standard 5-pound weight plates each. However, the pockets can be designed to hold a greater number of weights. On each of the front and rear panels of the vest there are 2 higher pockets holding up to 3 of the 2.5-pound plates and 2 lower pockets directly under them, holding up to 3 of the 5-pound plates. Up to 45 pounds in total of 2.5-pound and 5-pound Olympic plates may be added on each of the front and rear panels for a total of 90 pounds.

In another embodiment, the pocket maybe made of an elastic and stretchable material so that they may be stretched upon receiving the weight plates and then contract to further retain the weight plates in the pockets.

In another embodiment, each pocket has a supporting-plate at its bottom section to hold the weight plates. The supporting-plate, that is made from a rigid material may be sewed or attached by any attaching means and may have grooves or slots to receive the weight plates in a manner that each plate is placed in one groove to prevent any movement.

In a preferred embodiment, to secure the vest onto a user's body, a pair of "crisscrossed" shoulder straps is utilized. These straps originate on each of the front, bottom corners of the vest. They are easily fed through a loop attached to the respective (same side) bottom outside corner of the rear of the vest. The straps are then pulled back and forward and pulled up through belt buckles located on the upper opposite side of the vest and work in an "X" shape across the front of the user with each strap fastening to itself by hook-and-loop fasteners such as Velcro or other fasteners. This unique design further secures the weighted plates from movement.

In the preferred embodiment, the vest is made of material that is strong yet moisture resistant. It also contains foam paddings on the front and rear panels, and especially, on the shoulder portions. The front and rear panels can be connected to each other on the sides by the adjustable straps. Straps are fabricated from a tough, breathing, non-stretch and water-resistant webbing such as nylon.

A padded mesh interior lining provides optimal breathability, heavy-duty webbing for modular attachments, quick adjustment cinches, and quick release buckles or hook and loop material for securing the vest onto the user. The padding structure minimizes both injury and discomfort to the wearer.

It is, therefore, an object of the present invention to provide a weighted vest that can be used with standard Olympic weight plates provided in any exercise gym or sports training facility.

It is another object of the present invention to provide a set of pockets, two on the top of each side of the vest, and 2 on the bottom of each side of the vest. Each pocket can receive 1-3 plates of 2.5-pound standard Olympic weight plates (top pockets) or 5-pound standard Olympic weight plates (bottom pockets), or similar amounts in kilograms, or a number greater than 3 in different micro-plate weight amounts of less than 2.5 pounds or such equivalent amounts in kilograms.

It is another object of the present invention to provide a set of pockets that have a structure to securely receive and hold a plurality of Olympic weight plates in place, preventing and minimizing any movement of the weight plates while inside the pocket.

It is another object of the present invention to provide a weighted vest made of heavy-duty nylon fabric designed to allow for ease in breathing and mobility but to be as light as possible.

It is another object of the present invention to provide a weighted vest in a single size with adjustable straps that fits all wearers and is constructed to be gender non-specific.

It is further another object of the present invention to provide elastic breathable straps with quick adjustment capability.

It is further another object of the present invention to provide elements for locking the weights in place.

The above and still further objects features and advantages of the present invention will become apparent upon consideration of the following detailed description of specific embodiments thereof, particularly when taken in conjunction with the accompanying drawings wherein like reference numerals and the various figures are utilized to designate like components.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

The figures are not intended to be exhaustive or to limit the present invention to the precise form disclosed. It should be understood that the invention can be practiced with modification and alteration. The device disclosed herein, in accordance with one or more various embodiments, is described in detail with reference to the following figures. The drawings are provided for purposes of illustration only and merely depict typical or example embodiments of the disclosed invention. These drawings are provided to facilitate the reader's understanding of the disclosed invention and shall not be considered limiting of the breadth, scope, or applicability thereof.

Figure 1:
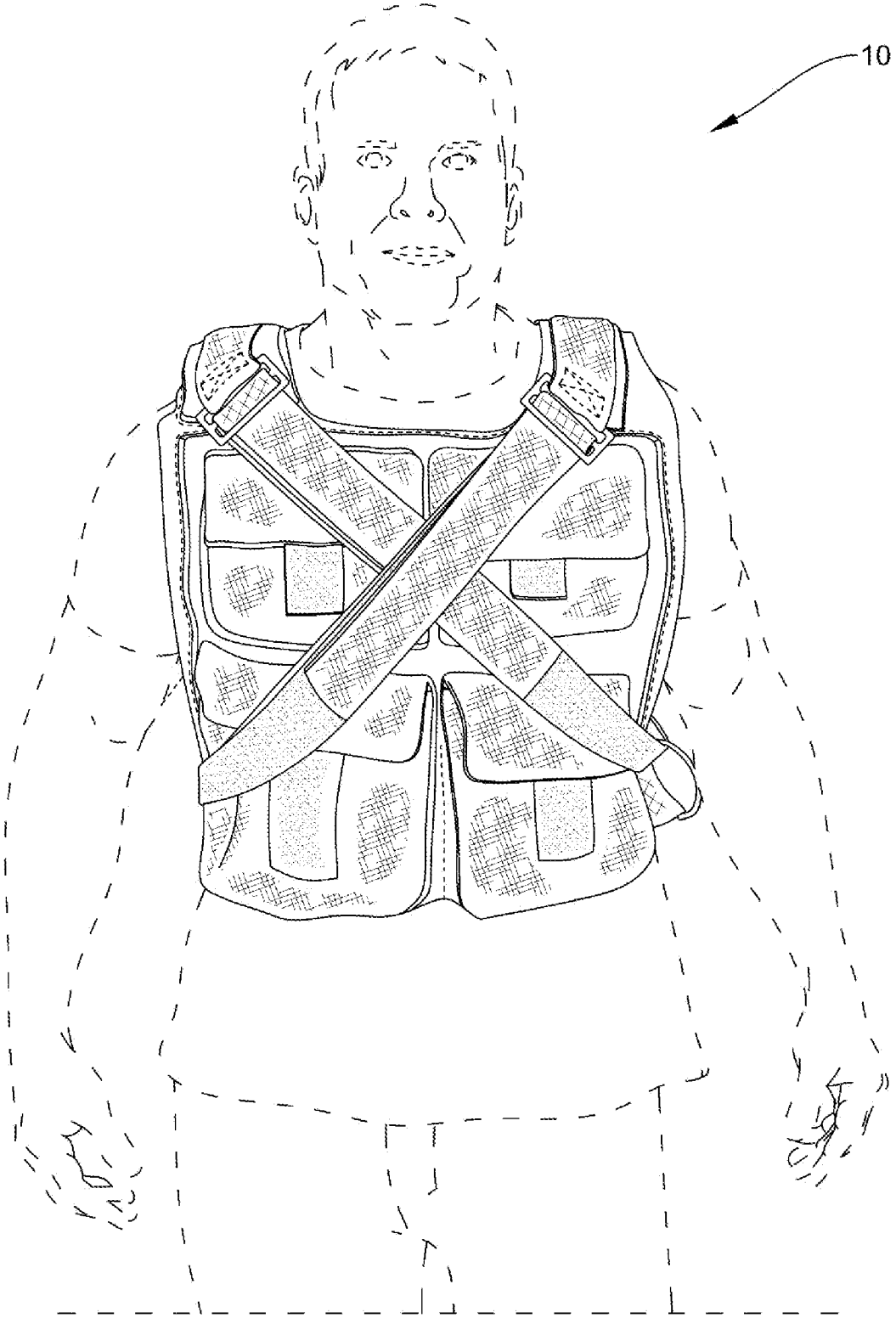
FIG. 1 is a perspective view of the Olympic weighted vest worn by a user.
Figure 2:
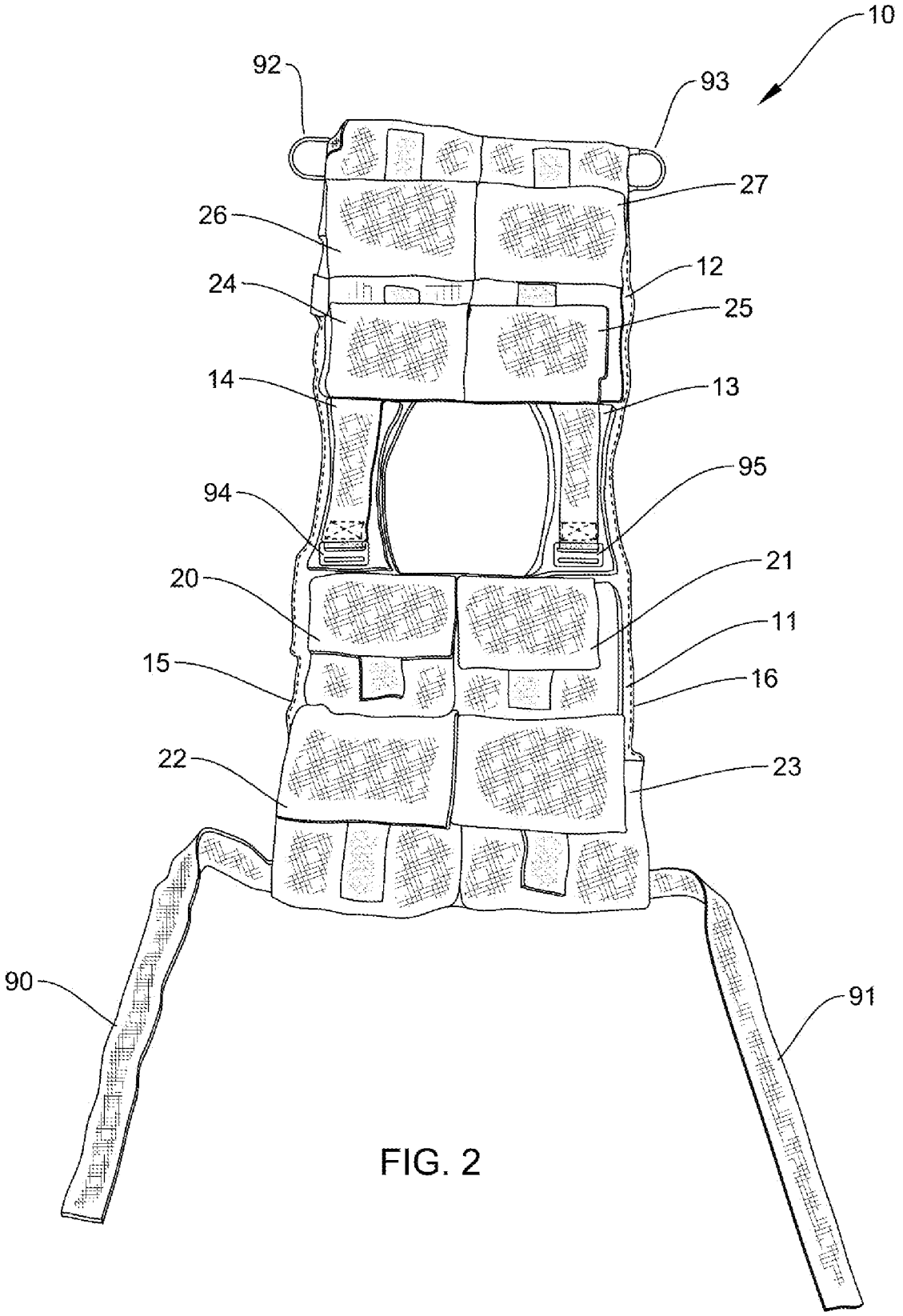
FIG. 2 is a perspective view of an exemplary embodiment of the Olympic weighted vest.

Referring to FIGS. 1 and 2 a weighted vest 10 to receive Olympic weight plates comprises of a front panel 11 and a rear panel 12 joined by shoulder portions 13 and 14. The sides of the vest 15 and 16 are open to prevent chaffing and to aid in cooling. The weighted vest 10 contains foam padding on the front panel 11, rear panel 12 and especially on the shoulder portions 13 and 14. An adjustable securing system is provided to secure the Olympic plate weighted vest onto the body of a user.

In a preferred embodiment, both the front panel 11 and the rear panel 12 are made of heavy-duty nylon fabric, or any other material that is strong yet moisture resistant or otherwise "water-proof". Plurality of vest pockets are made on both the front panel 11 and the rear panel 12 of the vest 10 by sewing or otherwise bonding. In the illustrated embodiment, there are four pockets 20, 21, 22 and 23, in two rows of two secured to the front panel 11, and four pockets 24, 25, 26 and 27 in the same arrangement secured to the rear panel 12. The upper pockets 20, 21, 24 and 25, close to the shoulder pads 13 and 14, are smaller than the lower pockets 22, 23, 26 and 27.

The two upper pockets on the front panel 20 and 21 and the two upper pockets on the rear panel 24 and 25 of the vest 10 receive 1 to 3 standard 2.5 pound Olympic weight plates, whereas the two lower pockets on the front panel 22 and 23 and the two lower pockets on the rear panel 26 and 27 of the vest 10 receive from 1 to 3 standard 5 pound Olympic plates.

Figure 3:
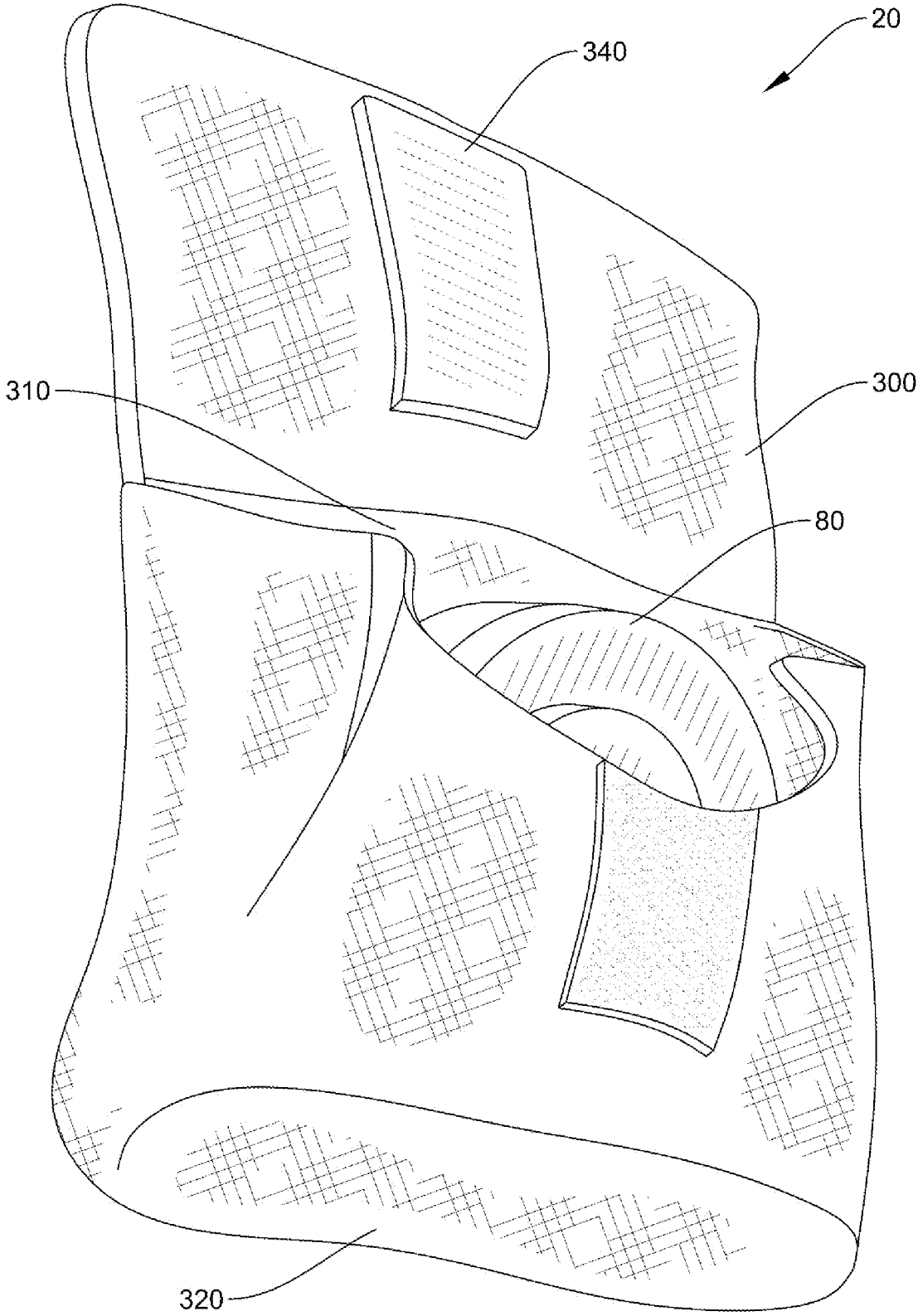
FIG. 3 is a perspective view of an embodiment of the weight pocket.
Figure 4:
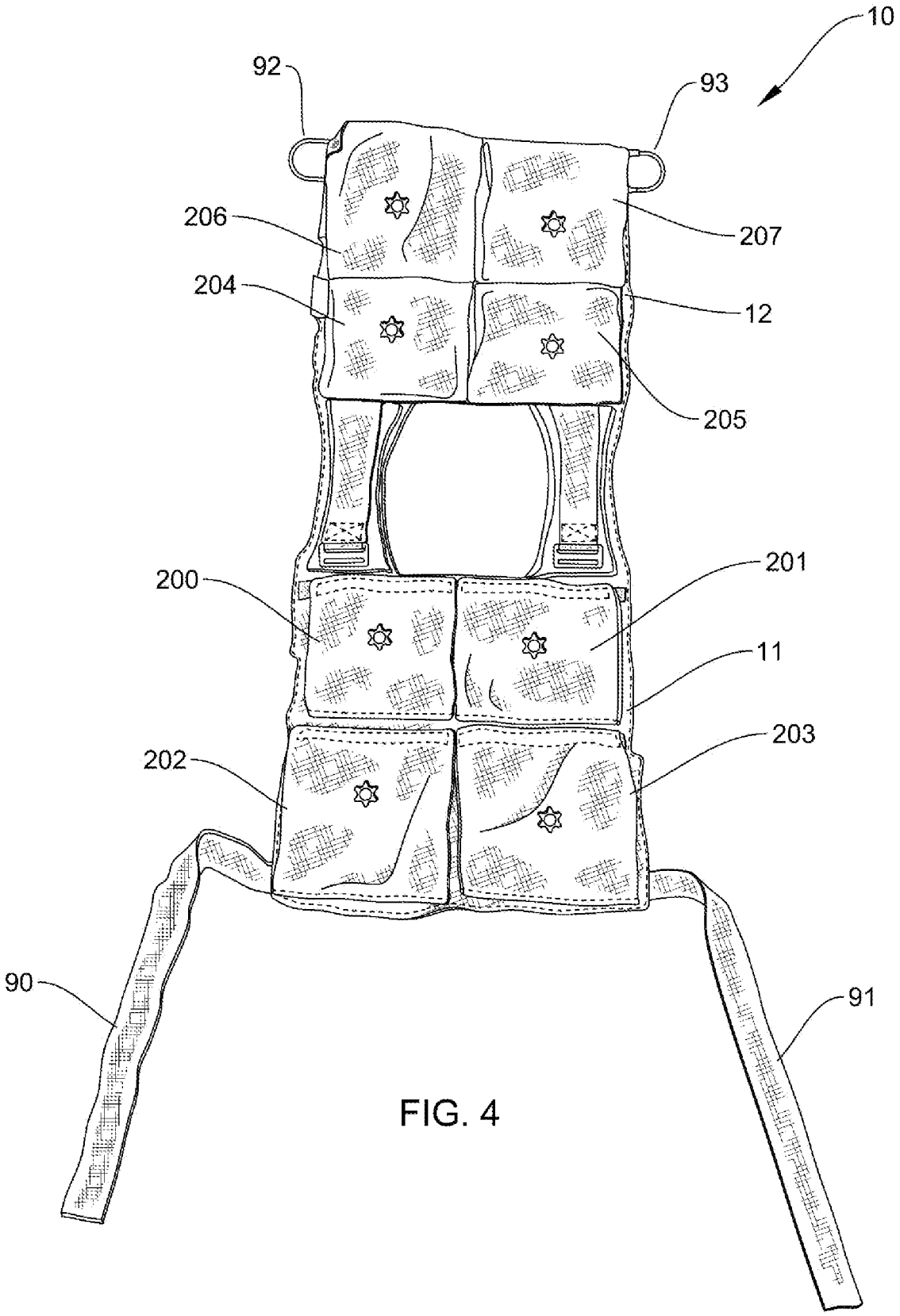
FIG. 4 is a perspective view of another embodiment of the Olympic weighted vest.

According to FIG. 3, in one embodiment, the vest pockets are constructed to receive the Olympic weight plates 80. Description of one of the sets of pocket 20 will suffice for all pockets. The pocket 20 is open on top 310 and has a shape sufficient to receive a standard Olympic weight plate 80. The pocket 20 is gusseted at the bottom 320 to provide adequate room and shape for the respective standard weight plates 80 that fit into them. Each pocket 20 has a pocket flap 300 with a hook and loop attachment 340 to secure the weight plates in the pocket. As shown in FIGS. 1, 2 and 3 the hook and loop attachments are extended over an entire or a substantial length of the flap 300 and the pocket 20, so that the flap 300 can be attached to the lower part of the pocket or the upper part of the pocket.

Figure 5:
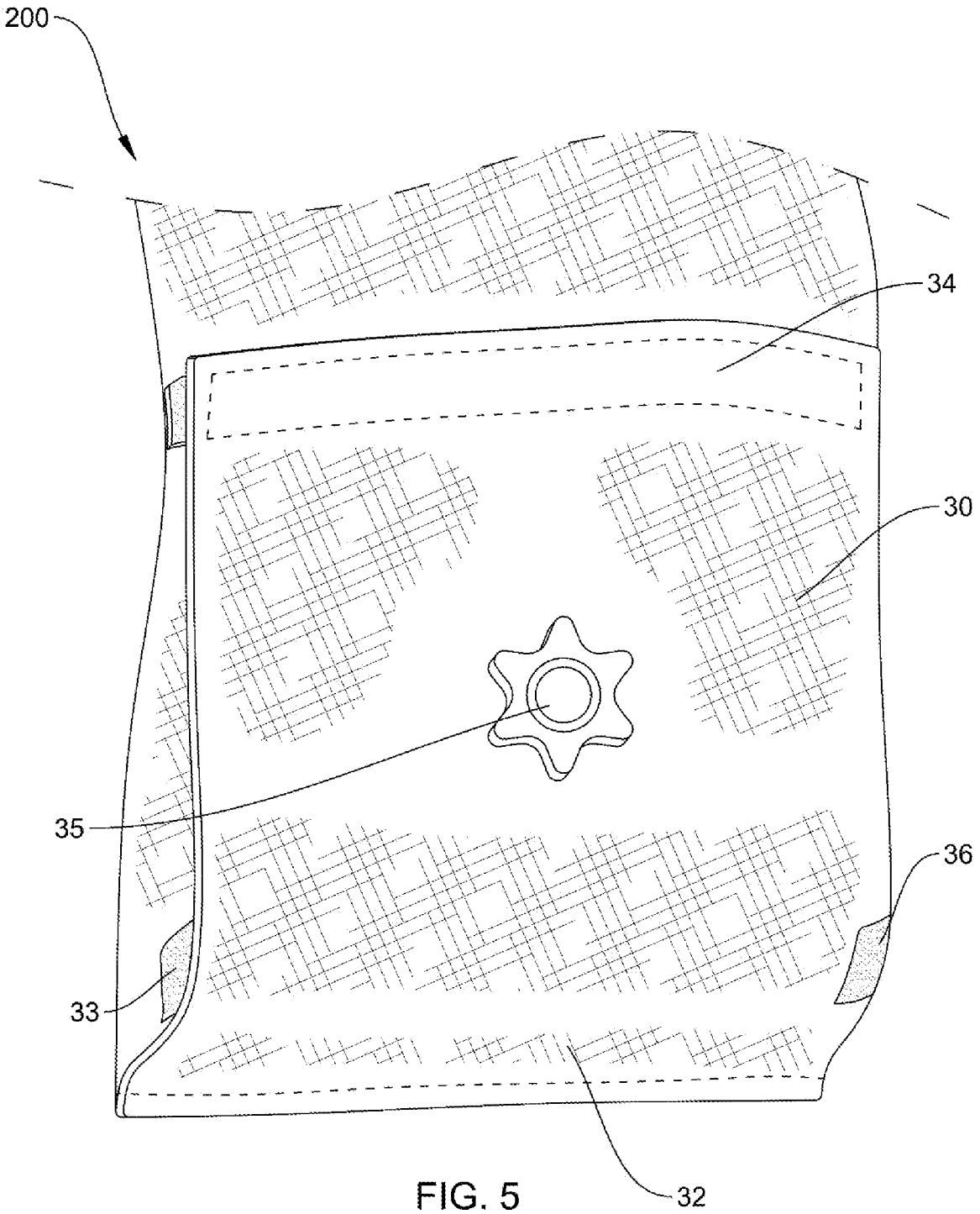
FIG. 5 shows an exemplary embodiment of a weight pocket in enlarged detail.
Figure 6:
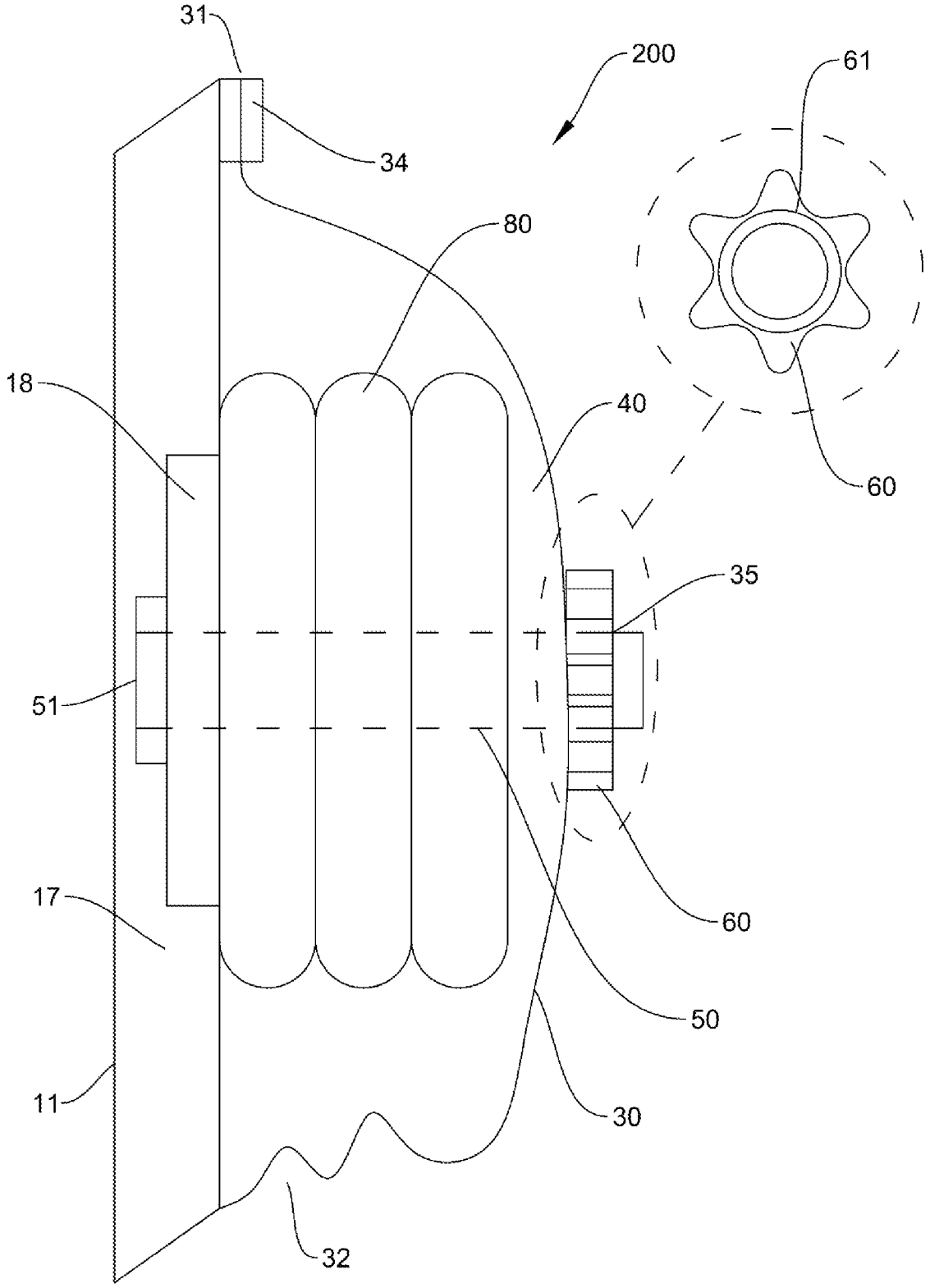
FIG. 6 is a side view of an embodiment of the weight pocket in closed position.
Figure 7:
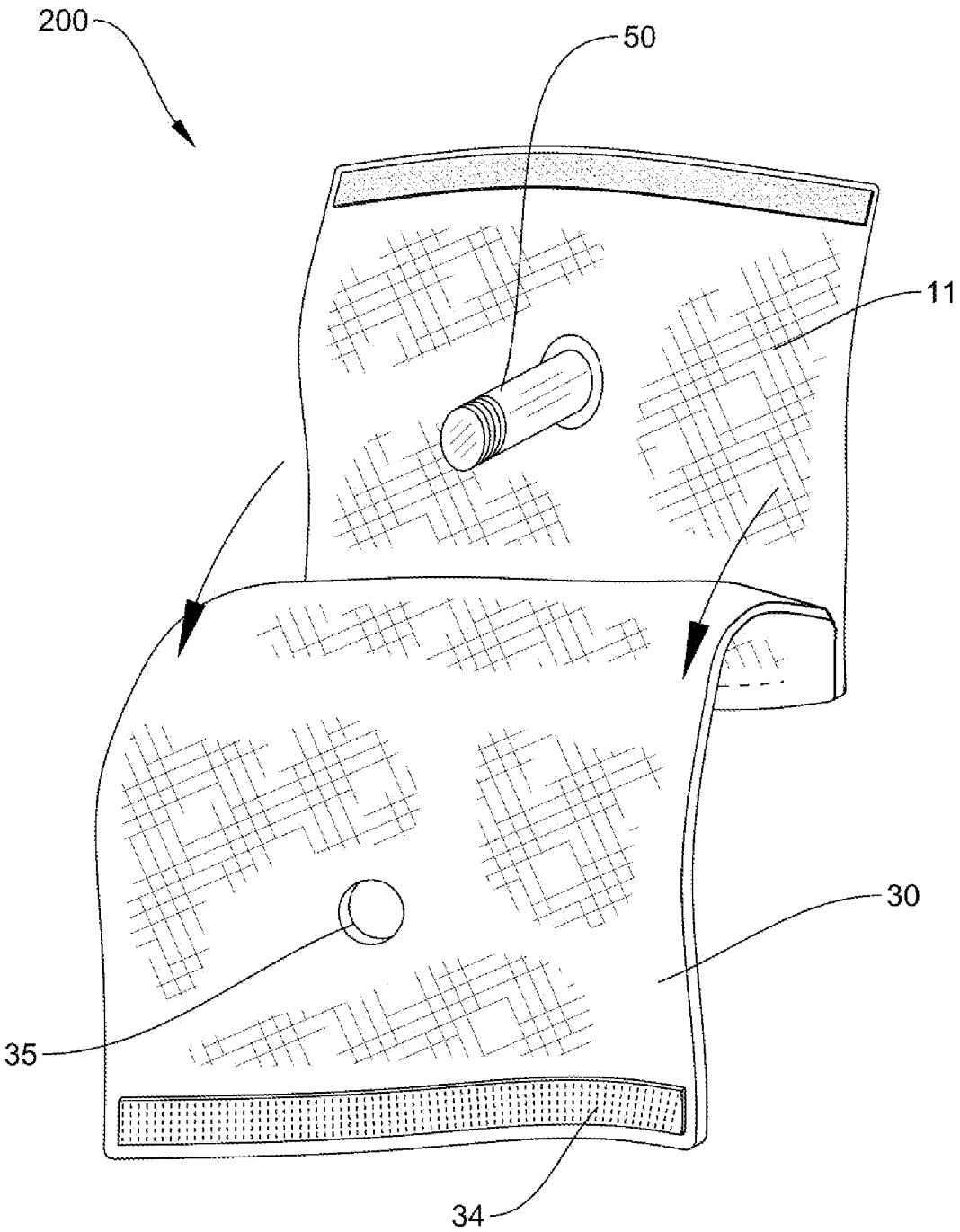
FIG. 7 is a perspective view of the weight pocket in open position.

Another embodiment of the vest pockets is disclosed in FIGS. 4 to 8. The vest pockets 200, 201, 202, 203, 204, 205, 206 and 207 have a construction which the description of one of the sets of pockets 200 will suffice for all pockets. As shown in FIGS. 5 and 6 the pocket 200 is open on top 31 and partially closed on the side edges 33 and 36. Each of the pocket 200 have a pocket flap 30 attached to the vest panels 11, 12 and suspended over the pocket opening 40 and have attaching means on its inner top portion 34. The flap 30 is permanently attached from a bottom end 32 to the panel-surface 11 and include a flap-attaching mechanism on a top end 31 to removably attach to the panel-surface 11. The pocket flap 30 has an aperture 35 in a predetermined center of the flap 30 which will be disclosed later.

The pocket 200 include a weight bar holder 50 with a length adapted to receive up to 3 Olympic weight plates. The bar element 50 is made of different rigid materials for example, aluminum or soft steel, and the other elements of hard steel to avoid misshaping of the bar. The bar element 50 is attached to the panel surface of the vest 11 from its distal end 51 and extends perpendicularly outward from the panel surface.

Figure 8:
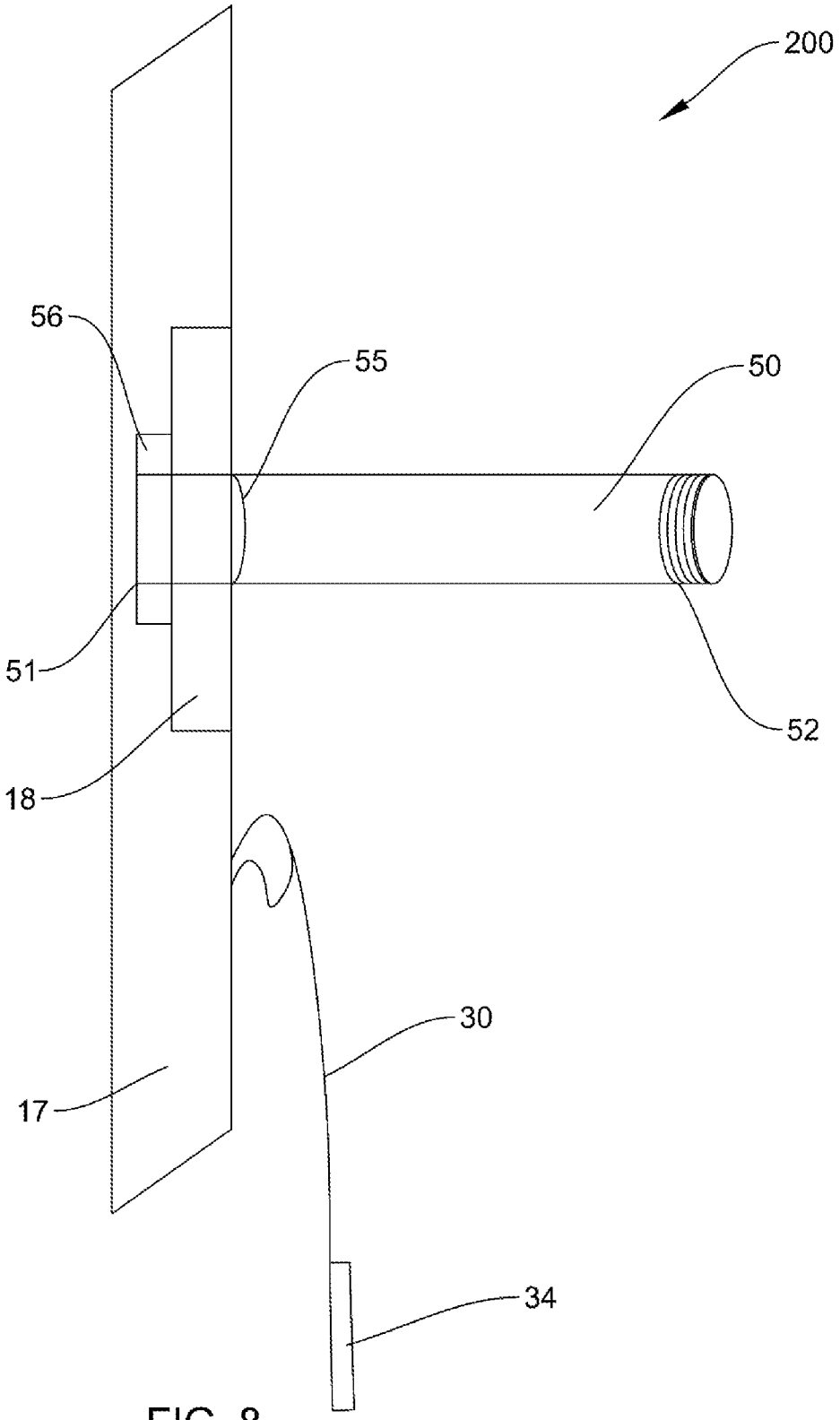
FIG. 8 is a side view of an embodiment of the weight pocket.

According to FIG. 8 the bar element 50 is in the form of a round shaft or rod to receive the weight plates 80 and includes a set of circumferential threads or grooves or slots 52 on its proximal end to receive a locking or securing nut or any other securing means. The bar element 50 has an adequate length and diameter to receive up to 3 Olympic weight plates. The bar element 50 is fastened from its distal end 51 to the foam padding structure 17 of the vest in a manner to hold the weight plates 80 in place without bending. The system uses a novel method for securely fastening the bar element 50 to foam padding structure of the vest 17. The vest panel 11 and 12 comprises of a pad 18 from a rigid material attached to the inner side of the pocket area to insert the bar element 50. An aperture 55 is constructed in the center of the pad 18. The bar member 50 is then protruded into the aperture 55 from its distal end 51 and fastened with a fastening means such as a washer or a cap 56.

The washer 56 is preferably a spring washer and is sized to fit around the bar element 50. The construction of the washer 56 and the pad 18 act as a fastener to keep the bar element 50 in tight. The distal end 51 of the bar element is seated in the interference portion of the aperture 55 so that the bar element 50 is unable to move.

The washer 56 may also be beneficially constructed of a metallic material. A cap may also be used as a fastener instead of the washer. The cap preferably may have a disc shape with a radius larger than the hole in the mounting portion. The cap may also be constructed of a metallic material for easy attachment to the rod. The pad 18 may be attached by any suitable method to the panel-surface 11 and 12 of the vest in the pocket area. The distal end of the bar element 51 may then be extended through the aperture 55 and affixed with the washer 56 or cap. Any other connecting systems, for example molding, can be used to attach the bar element 50 to the pad 18.

According to FIGS. 5 and 6 again the aperture 35 in the center of the pocket flap 30 have an appropriate diameter so that, when it flaps over the pocket opening 40 the bar element 50 with the weight bars 80 thereon can stick out of it and secured by a locking nut (a securing means) 60. This will prevent the weight plates 80 from falling off the bar element 50. The locking nut 60 is in the form of a locking collar preferably circular, and have a central hole 61 therethrough, dimensioned for receiving the proximal end of the bar element 50. The locking nut (collar) 60 is then fastened on the proximal end of the bar element 50 and pivots on the threading grooves of the proximal end of the bar element 50 extended outwardly from the pocket flap aperture 35 so that the locking collar 60 engages the weight plates 80 and grips it tightly. A single weight plate 80, or a plurality of weight plates 80 are then gripped in tight position.

Figure 9:
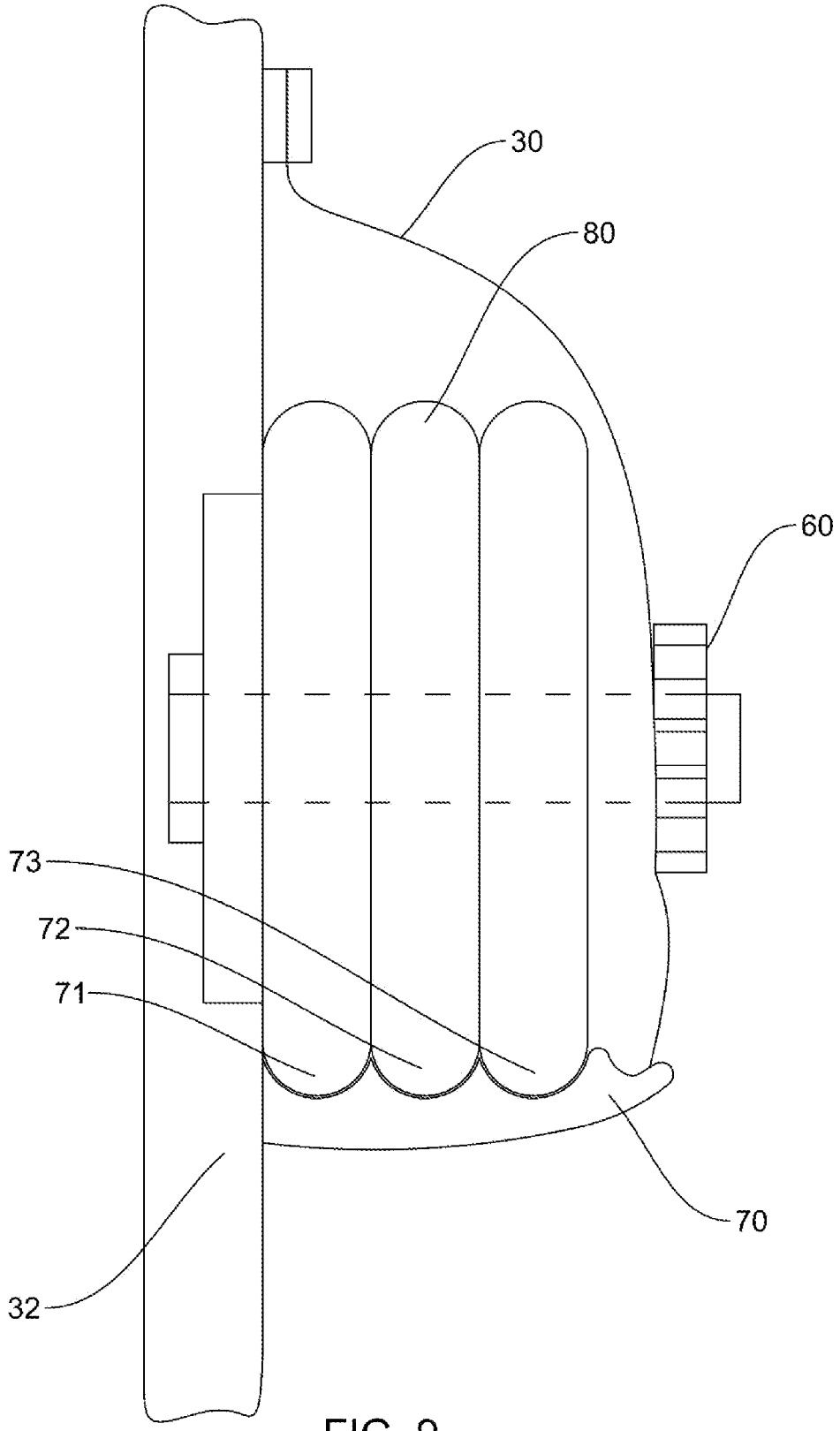
FIG. 9 is a side view of another embodiment of the weight pocket.
Figure 10:
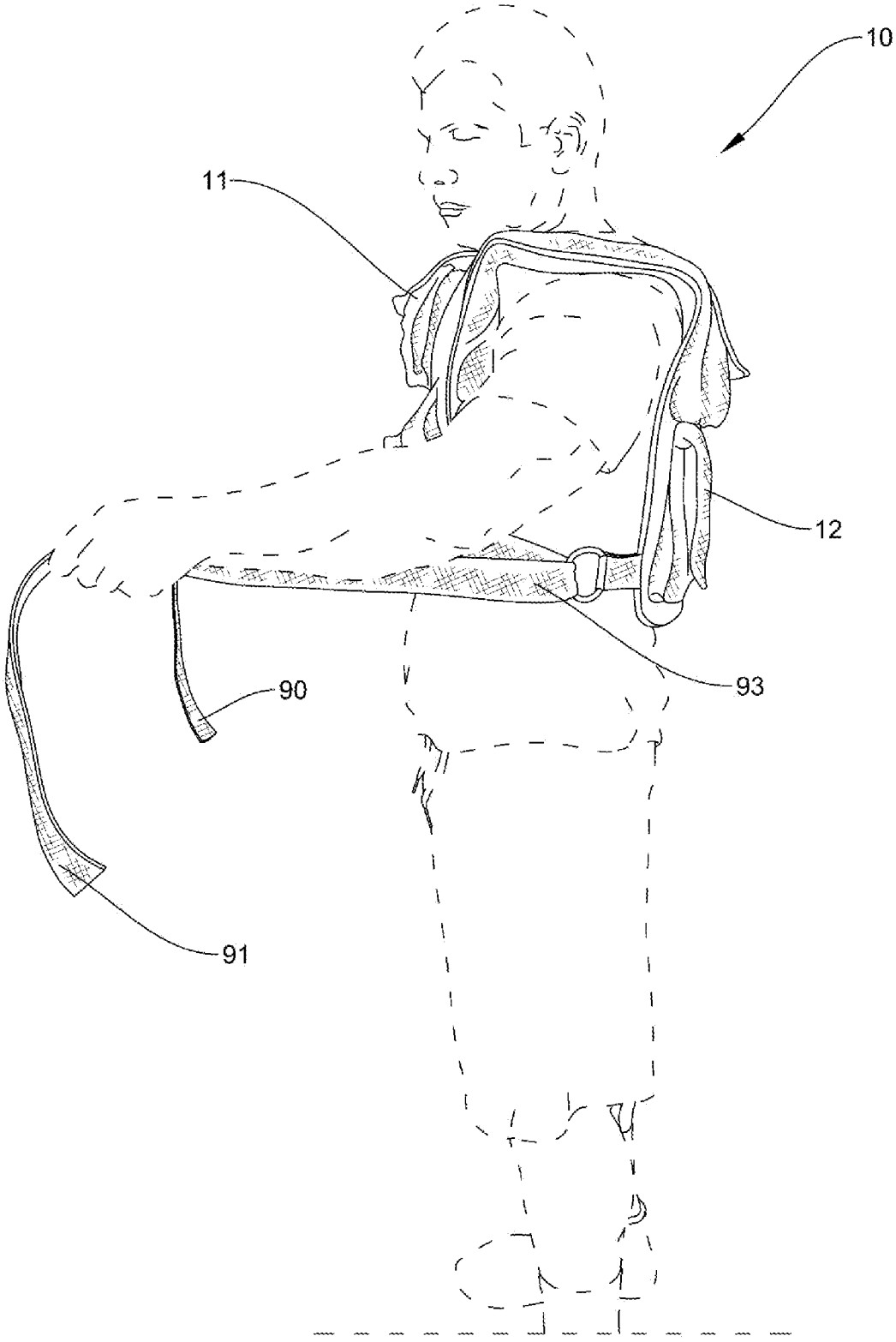
FIG. 10 shows the method to secure the present invention on the user's body.
Figure 11:
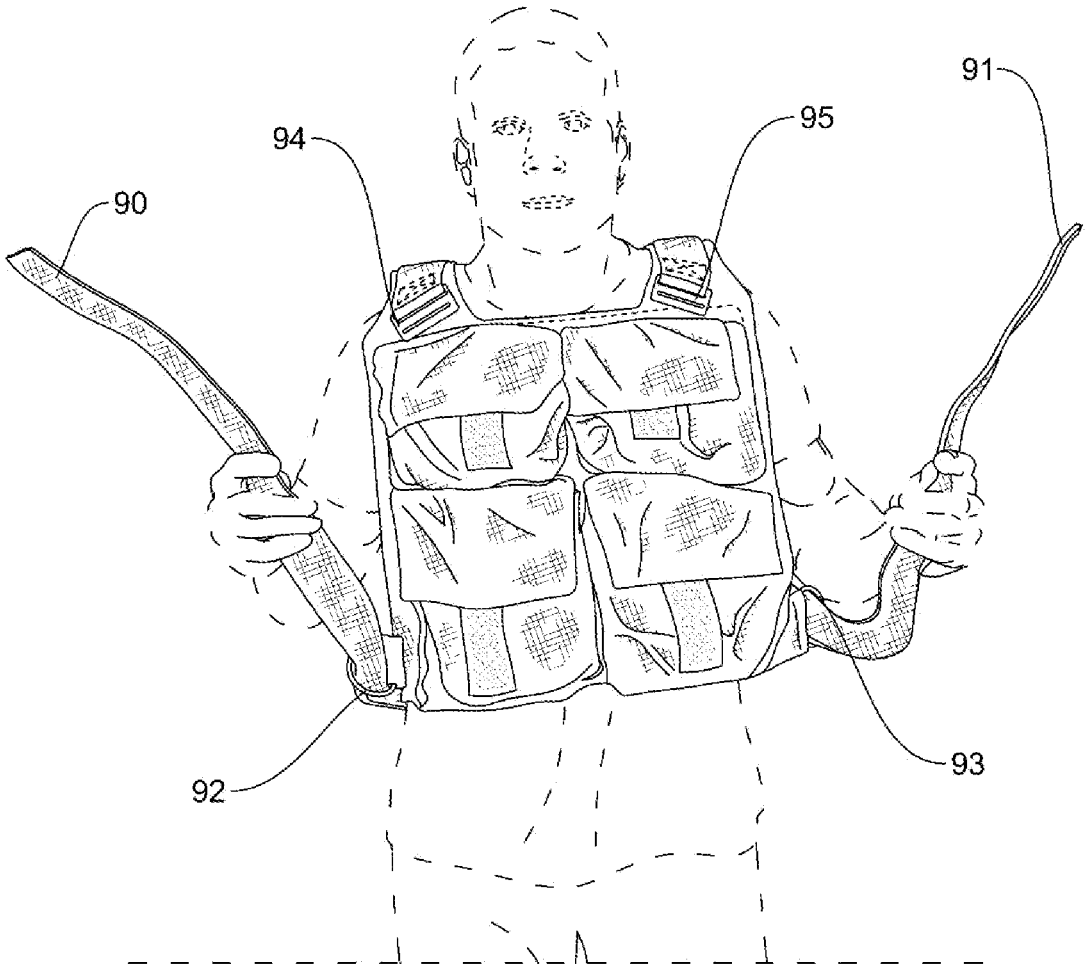
FIG. 11 shows the method to secure the present invention on the user's body.
Figure 12:
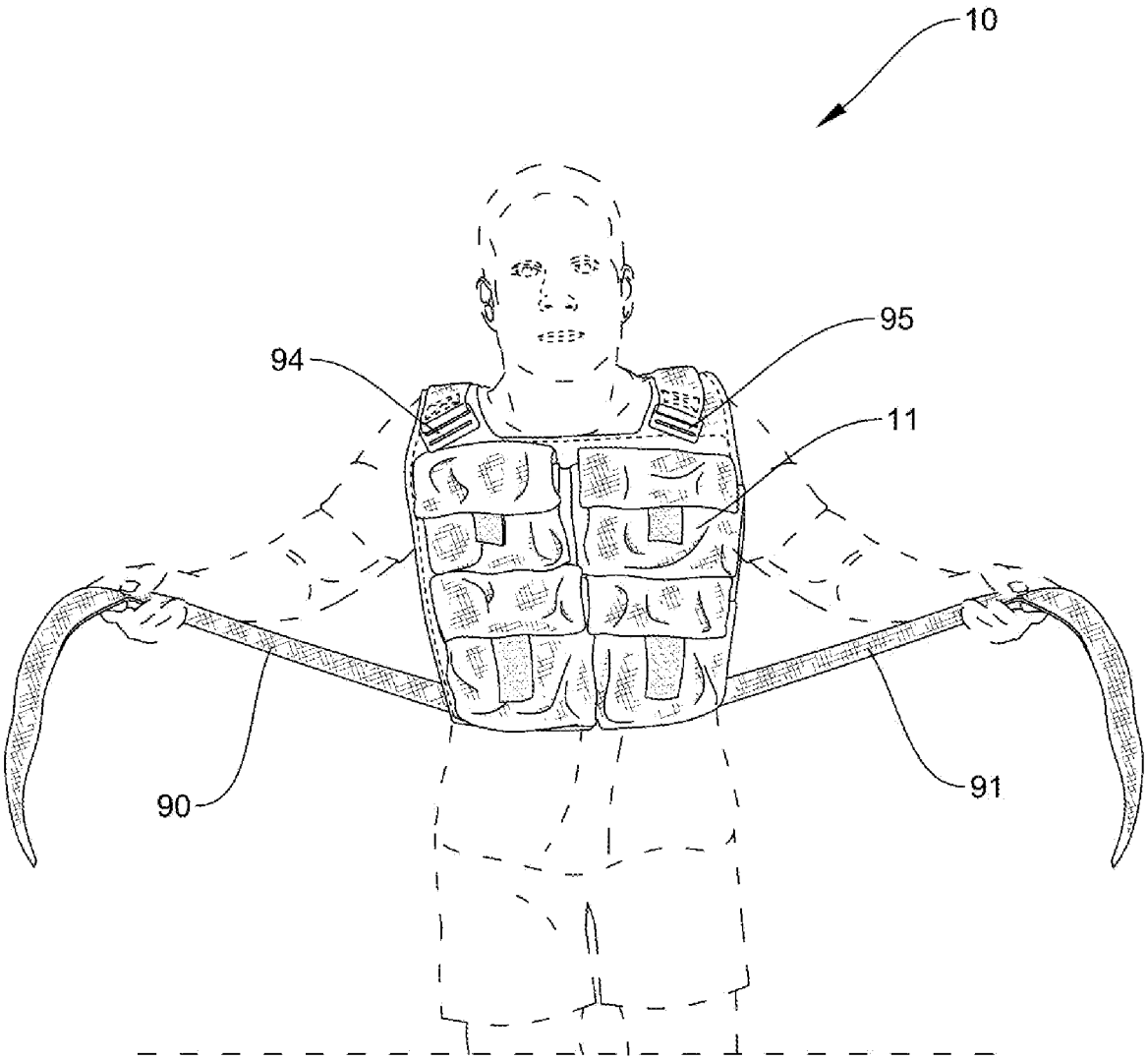
FIG. 12 shows the method to secure the present invention on the user's body.
Figure 13:
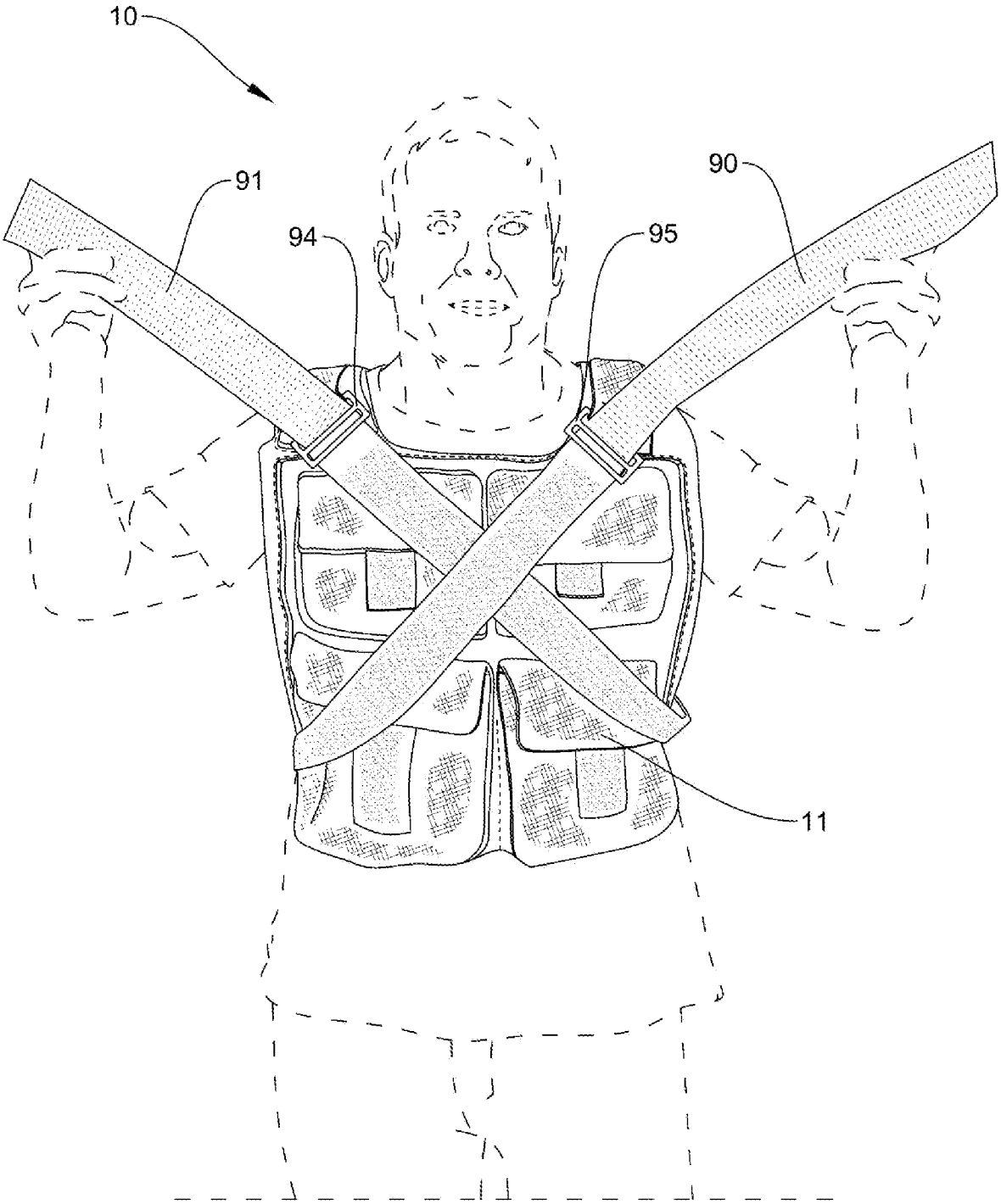
FIG. 13 shows the method to secure the present invention on the user's body.
Figure 14:
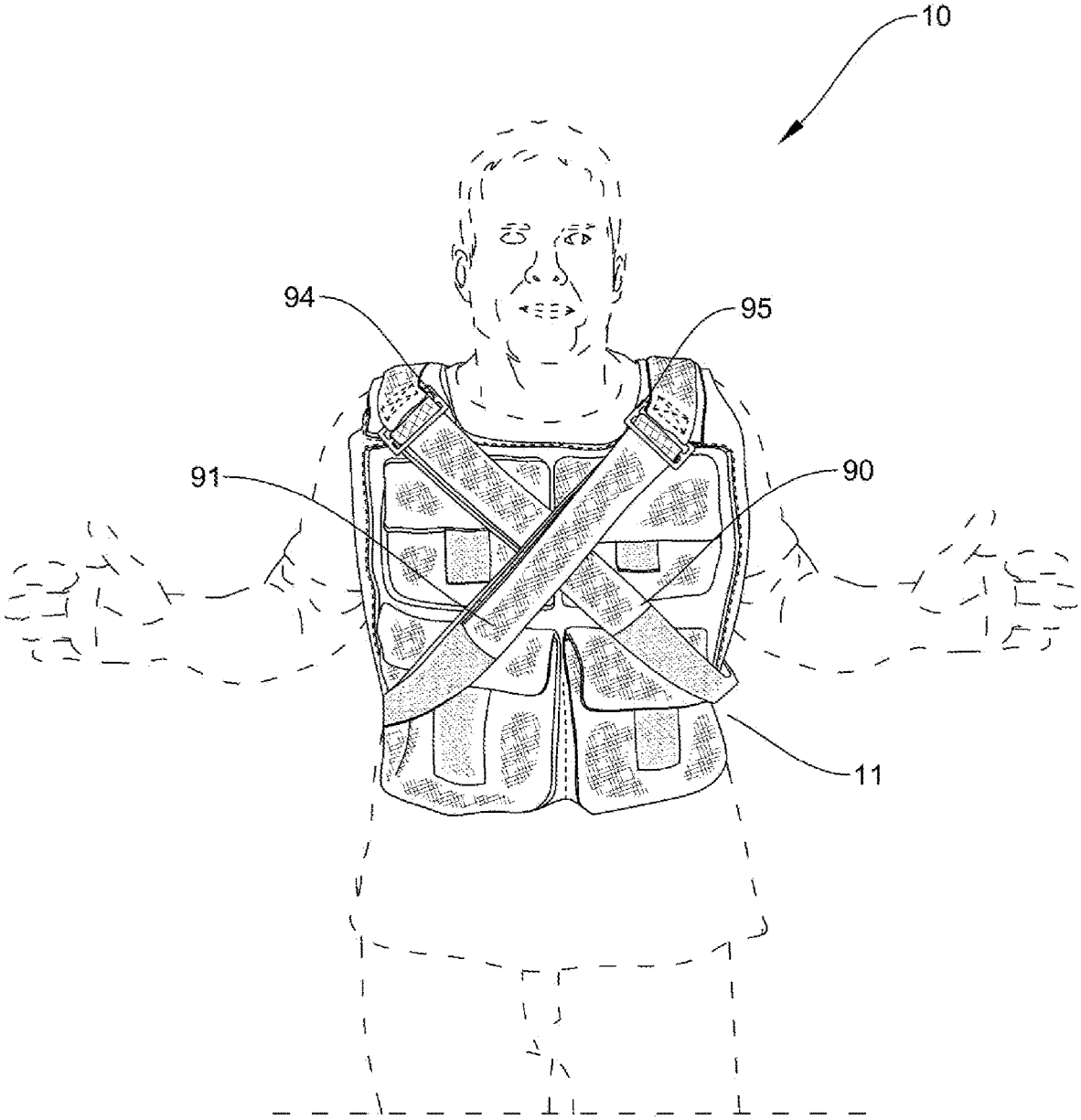
FIG. 14 shows the method to secure the present invention on the user's body.

According to FIG. 9 the bottom part 32 of the vest pocket 200 may include a supporting plate 70. The supporting plate 70 may have a plurality of grooves to accommodate a number of weight plates preferably 3 grooves, 71, 72 and 73 according to the present invention. Each weight plate 80 will be placed in a groove after stacked into the bar element 50 and positioned securely in the pocket and secured by the pocket flap 30 and the locking collar 60.

It will be appreciated that the length and diameter of the grooves 71, 72 and 73 are dimensioned for that purpose to support the weight plates 80 in place and prevent them to move while the user is exercising. In an embodiment, a partial separation is stitched within the support plate of each pocket. The support plate 70 provides added strength to the vest pocket 20 to better support the weights.

Referring to FIGS. 6 and 7 again the pocket flap 30 will be attached to the upper portion of the pocket area 31 to the panel-surface 11 and 12 by fastening means such as hook and loop strips or other closure arrangements such as snaps, zipper, etc., to permit easy selective closure of the pocket top opening 31. The fasteners are long and large enough to adjust the size of the pocket. Therefore, each pocket may tightly hold one or more weight plates by simply adjusting the closed flap length.

An important feature of the invention is the use of Olympic weight plates 80 which are flat and usually made of cast iron. Olympic weight plate, regardless of the weight or size have a standard centre hole of approximately 2 (two) inches (50.2 mm). Generally, Olympic weight plates 80 are in the shape of solid discs in variable diameters and widths, aside from the constant and standard centre hole of 50.2 mm. One benefit offered by the Olympic weighted vest is that the vest can be carried by the user and used in any gym. The bar element 50 in the present invention is approximately 50 mm in diameter so that the central hole of a weight plate(s) 80 can be located and fitted onto the bar element, and be more stable during user's movements.

Weight plates 80 are commonly available in 2.5, 5, 10, 25, 35, and 45 pound sizes. Various kilogram weighted sizes are also available in similarly or slightly different weights. Standard Olympic micro-plate sizes similar and smaller than 2.5 pounds in size and weight are also commonly available in 0.25 0.5, 1, and 1.25 kilogram sizes. The 4 upper pockets 20, 21, 24 and 25 on the vest 10 are designed to receive different Olympic sized weights 80 up to and including up to 3 (three) standard 2.5 pound Olympic plates. The 4 larger lower pockets 22, 23, 26 and 27 on the vest 10 are designed to receive different Olympic sized weights 80 up to and including up to 3 (three) standard 5 pound Olympic plates 80.

Referring to FIGS. 8 to 14 the vest 10 comprises of a foam padding throughout most of the vest 10, especially on the shoulder portions, 13, 14. The foam paddings have a thickness of about one-quarter to one-half inch to provide comfort during exercise. The weight plates 80 are spaced by two padding layers from the wearer's body. The total length of the vest 10 is short enough to allow unhindered movement of a user. It is also designed to be as light as possible without the added plates. It is also designed to be as comfortable as possible when loaded with any amount of Olympic weight plates 80. It is also designed to be as flexible as possible to allow the most natural and unencumbered or unhindered movement by the user in general.

The padding structure and the flat Olympic plates 80 are devoid of any irregularity of structure that would interrupt the smooth surface of the vest 10 on the body. This feature minimizes both injury and discomfort to the wearer. The base of pockets 20 to 27 and 200 to 207 may be reinforced with a double layer of material, or the like, to prevent the bottom edge of the pockets 20 to 27 and 200 to 207 from tearing away from the vest panels 11 and 12 under the force exerted by the weight plates 80. The pockets maybe made of elasticized, stretchable material so that they may be stretched upon receiving the weight plates 80 and then contract to further retain the weight plates 80 in the pockets.

Referring to FIG. 1 and accompanying drawings of FIGS. 10 to 14 again show the steps and method to secure the vest 10 onto users of almost any size and with any variation of standard Olympic plates 80. In order to have a firm fit and extra stability, a pair of "criss-crossed" shoulder straps 90 and 91 are utilized. These straps 90 and 91 originate in each of the bottom corners of the front panel 11 of the vest 10. The straps 90 and 91 are fed through a pair of loops 92 and 93 attached to the respective (same side) bottom outside corners of the rear panel 12 of the vest 10. The straps 90 and 91 are then pulled forward and work in an "X" shape across the front panel 11 and pulled up fed through another pair of belt buckles 94 and 95 on the shoulder portions and back down across the front of the front panel so that each strap 90 and 91, fastens onto itself by hook-and-loop fasteners such as (Velcro) or other fasteners. This unique design further secures the weighted plates 80 from movement, in addition to the flaps securing the plates in their respective pockets.

The front and rear panels 11, 12 are open below the wearer's arms and are pulled together beneath the arms by closure of straps. The front panel formed without a front opening, thereby requiring the vest to be donned as a pullover, in which the straps tightening brings the sides of panels together under the wearer's arms.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. An Olympic plate weighted vest comprising:

a) a front panel and a rear panel each having a panel-surface, a top portion and a bottom portion and a pair of shoulder panels joining the front panel and the rear panel;

b) a plurality of pockets on the front panel and the rear panel adapted to hold a plurality of Olympic size plate weights, and c) an adjustable securing system to secure the Olympic plate weighted vest onto a body of a user comprising:

i. a pair of adjustable straps each having a first end and a free second end, and wherein the first end is attached to the bottom portion of the front panel, and the second end has a hook and loop material;

ii. a pair of loops, each attached to a corner of the bottom portion of the rear panel;

iii. a pair of belt buckles attached to an outer portion of the pair of shoulder panels, wherein the pair of adjustable straps are fed through the loops on the rear panel and then pulled forward across the body of the user, the pair of adjustable straps are pulled up and work in an "X" shape across the front panel and are then fed through the pair of belt buckles on the shoulder panels, and then each of the pair of adjustable straps attach to the same strap by the hook and loop material, thereby the front panel and the rear panel are pulled together by closure of the straps.

2. The Olympic plate weighted vest of claim 1, wherein each pocket is gusseted to allow pocket expansion to fit the plurality of Olympic size plate weights, and further having a flap with an attachment mechanism to secure the plurality of Olympic size plate weights in each pocket.

3. The Olympic plate weighted vest of claim 1, wherein each pocket comprises:

a) a weight bar holder having a distal end and a proximal end with a length adapted to receive the plurality of Olympic size plate weights, wherein the weight bar holder is attached to the panel-surface from the distal end and extends perpendicularly outward from said panel-surface;

b) a flap permanently attached from a bottom end to the panel-surface below said weight bar holder, and having a flap-attaching mechanism on a top end to removably attach to the panel-surface above the weight bar holder, and an aperture to receive said weight bar holder, whereby the Olympic weight plates are placed on the weight bar holder and the flap is extended over the weight bar holder to secure the Olympic weight plates in place.

4. The Olympic plate weighted vest of claim 3, further having a removable locking mechanism to lock on the weight bar holder to secure and lock the Olympic weight plates and the flap.

5. The Olympic plate weighted vest of claim 3, wherein the flap-attaching mechanism is a hook and loop strip or a snap or a zipper.

6. The Olympic plate weighted vest of claim 1, wherein the front panel and the rear panel each have four pockets arranged as two top smaller pockets and two bottom larger pockets, wherein each of the top smaller pockets are sized to receive 1 to 3 standard 2.5 pound Olympic weight plates and each of the bottom larger pockets are sized to receive 1 to 3 standard 5 pound Olympic plates.

7. The Olympic plate weighted vest of claim 1, wherein the front panel and the rear panel are made of a heavy-duty nylon fabric or a microfiber that is strong and moisture resistant.

8. The Olympic plate weighted vest for exercising of claim 3, wherein said weight bar holder is made of a rigid material, preferably made of hard rubber or aluminum or steel.

* * * * *